US007195371B2

(12) United States Patent
Thuma et al.

(10) Patent No.: US 7,195,371 B2
(45) Date of Patent: Mar. 27, 2007

(54) POCKET FLASHLIGHT APPARATUS

(75) Inventors: Michael Thuma, LaGrange, IL (US); Paul Mann, Oak Park, IL (US)

(73) Assignee: NTM Industries, LLC, LaGrange, IL (US)

( * ) Notice: Subject to any disclaimer, the term of this patent is extended or adjusted under 35 U.S.C. 154(b) by 0 days.

(21) Appl. No.: 10/773,994

(22) Filed: Feb. 6, 2004

(65) Prior Publication Data

US 2005/0174764 A1 Aug. 11, 2005

(51) Int. Cl.
*B25B 23/18* (2006.01)

(52) U.S. Cl. ..... 362/199; 362/119; 362/202; 362/120; 362/197

(58) Field of Classification Search ..... 362/119, 362/202, 120, 197
See application file for complete search history.

(56) References Cited

U.S. PATENT DOCUMENTS

| | | | | |
|---|---|---|---|---|
| 1,363,664 | A * | 12/1920 | Livingston | 248/688 |
| 4,739,457 | A * | 4/1988 | Orr | 362/287 |
| 5,410,457 | A * | 4/1995 | Parker | 362/205 |
| 6,186,638 | B1 * | 2/2001 | Chang | 362/119 |
| 6,273,582 | B1 * | 8/2001 | Taggart et al. | 362/119 |

* cited by examiner

*Primary Examiner*—Sandra O'Shea
*Assistant Examiner*—Anabel Ton
(74) *Attorney, Agent, or Firm*—Niro Scavone, Haller & Niro

(57) ABSTRACT

A pocket flashlight includes a base member, a light emitting member, and a support member. These members lie pivotally connected to one another. The light emitting member includes a light source, a power source connected to the light source, and a housing for containing the light source and the power source.

16 Claims, 3 Drawing Sheets

POCKET FLASHLIGHT APPARATUS

BACKGROUND OF THE INVENTION

1. Field of the Invention

The present invention relates to a pocket flashlight apparatus, and more particularly to an articulated flashlight apparatus including a light emitting member and a base member such as a multi-function tool which provides a stable base and allows the light emitting member to assume multiple positions.

2. Description of the Prior Art

The prior art includes a wide variety of utility flashlights, including light weight, pocket size devices found in the commercial and camping markets. The most notable of the pocket size devices is the MAGLITE™ line of flashlights. These devices typically include a light bulb, batteries and a housing to contain them, as do most conventional flashlights.

The prior art also includes a number of multi-functional tools that combine different tool heads into a common handle. The tool heads fold or pivot into the handle; and they can unfold or pivot out of the handle (either separately or collectively). The most notable of these devices is the SWISS ARMY™ line of products.

It is desirable for a pocket size flashlight to include support structure for placing the flashlight in different positions and allowing hands-free operation of the flashlight. It is also desirable for a pocket size multifunction tool to include a flashlight as one of its components. Finally, it is desirable that these tools and flashlights have a compact and a light weight construction.

The pocket flashlight apparatus of the present invention provides a pocket size, multi-function tool with a flashlight component. It provides a stable base that allows an operator to place the flashlight component in a number of positions without holding it there with his or her hands. This construction is simple and compact; it is light weight and easy to manufacture and operate.

SUMMARY OF THE INVENTION

In accordance with this invention, a flashlight apparatus includes a base member, a light emitting member, and a support member. The base, light-emitting, and support members lie pivotally connected to one another. In one embodiment, the base member includes a pocket size multi-function tool disposed in end-to-end relation with the light emitting member; and the support member of this embodiment includes at least one leg portion pivotally mounted to the tool.

BRIEF DESCRIPTION OF THE DRAWINGS

For a more complete understanding of this invention, one should now refer to the embodiments illustrated in greater detail in the accompanying drawings and described below as examples of the invention. In the drawings.

While the following disclosure describes the invention in connection with one embodiment and a number of modifications, one should understand that the invention is not limited to this embodiment. Furthermore, one should understand that the drawings are not to scale and that graphic symbols, diagrammatic representations, and fragmentary views, in part, may illustrate the embodiment. In certain instances, the disclosure may not include details which are not necessary for an understanding of the present invention.

DETAILED DESCRIPTION OF THE DRAWINGS

Figure 1:
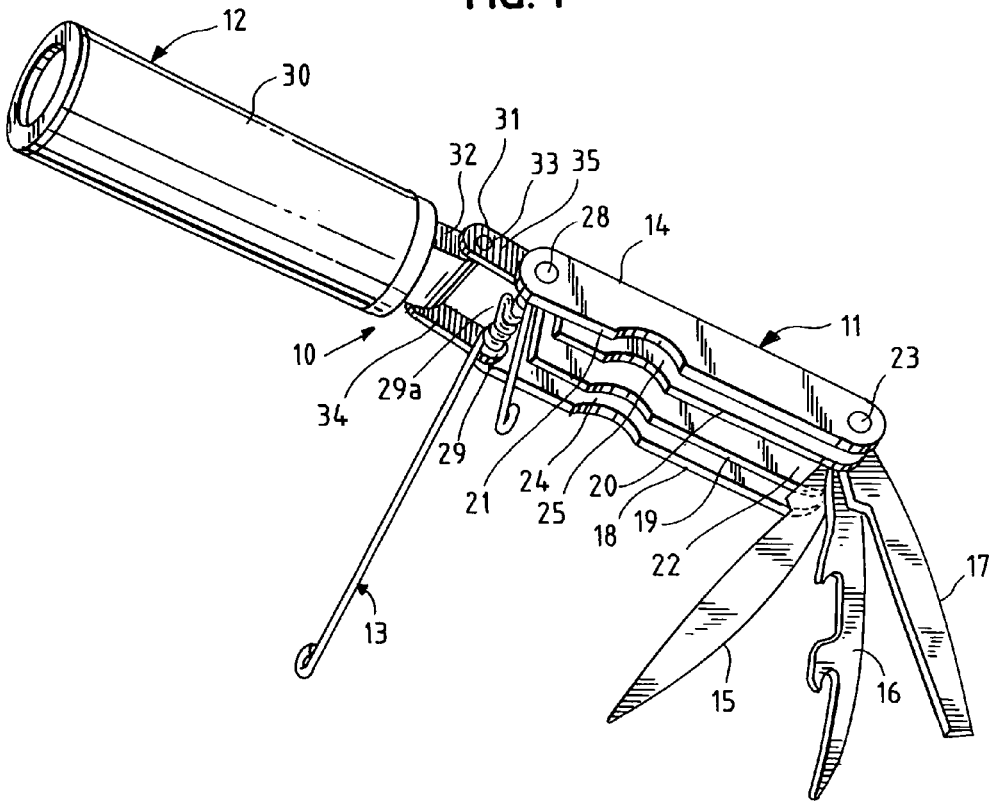
FIG. 1 is a perspective view of the pocket flashlight apparatus of the present invention.
Figure 1A:
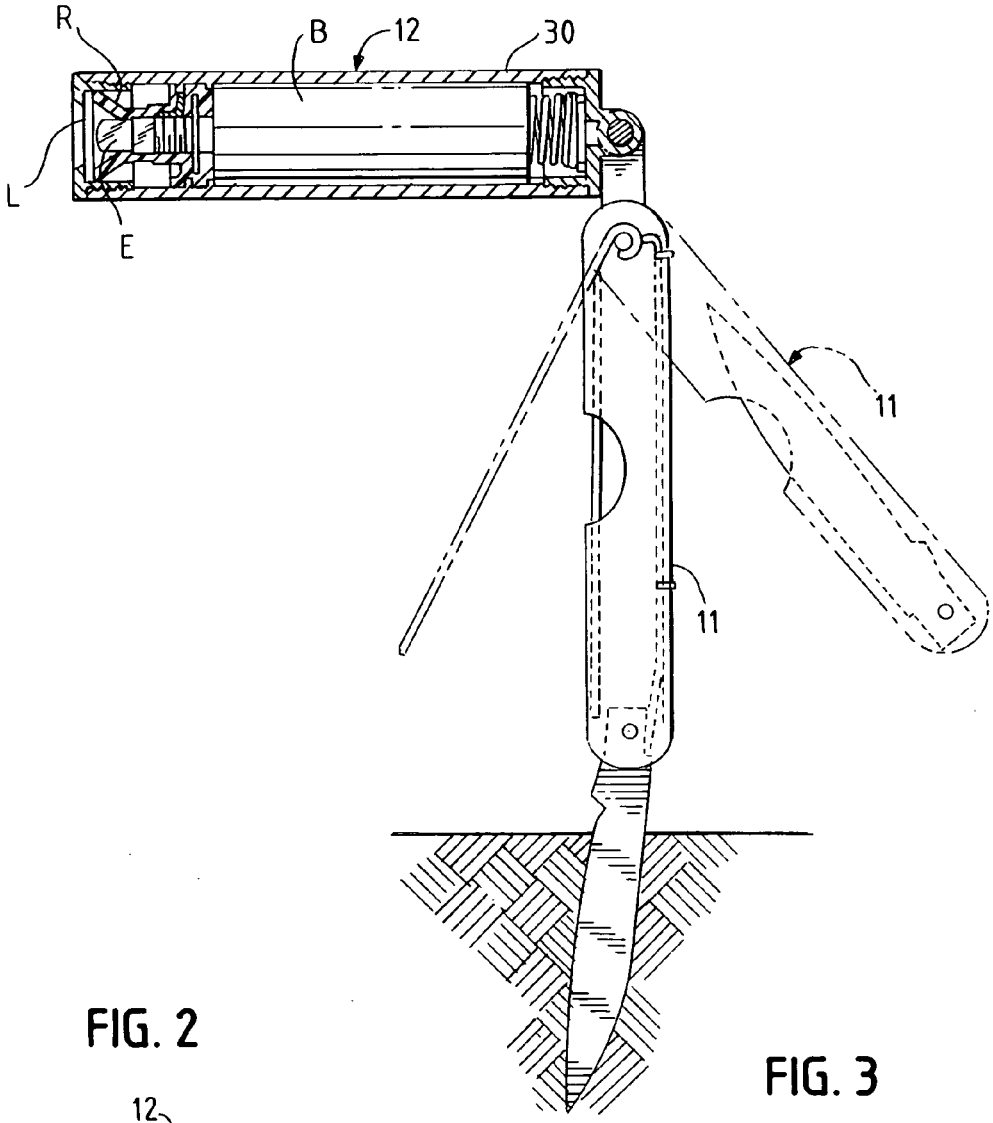
FIG. 1A is a partially sectional and partially elevational view of the pocket flashlight apparatus shown in FIG. 1.
Figure 2:
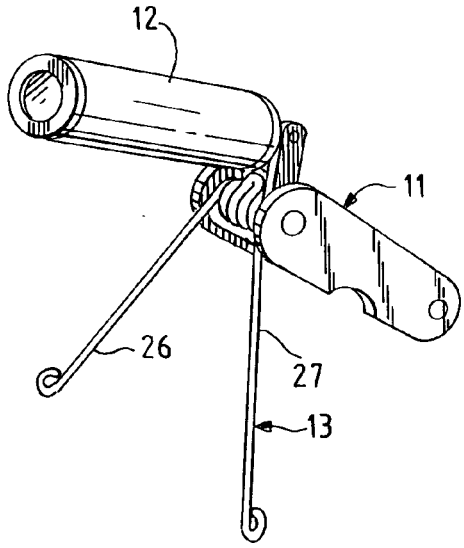
FIG. 2 is another perspective view of the apparatus shown in FIG. 1 with base and support members configured to form a base for the light-emitting member.

Turning now to the drawings and referring specifically to FIGS. 1 and 2, the pocket flashlight apparatus of the present invention shown at 10 generally includes a base member 11, a light-emitting member 12, and a support member 13. The base member 11 comprises a pocket size, multi-functional tool with a housing 14 and tool segments 15–17, including a knife 15, a bottle opener 16 and a file 17. The tool segments 15–17 are made of steel or other suitable material 17. One may interchangeably use many other available tools (e.g., scissors, screw drivers, etc.) and tool assemblies within and outside of the housing 14.

The housing 14 is made out of aluminum or any other material of high strength and rigidity. It functions as a housing for the tool segments 15–17, a handle for the apparatus 10, and a portion of a base for the light-emitting member 12. It includes generally parallel portions 18, 19, 20 and 21 that define an elongate center space 22 for containing the tool segments 15–17 which lie pivotally secured by a pin 23 to the housing 14 at one end of the housing. The portions 18–21 also define outer spaces 24 and 25 for containing the leg portions 26 and 27 of the support member 13.

The support member 13 lies pivotally connected to the housing 14 by a pin 28 which extends through the housing 14 at an end opposite the end with the pin 23. This support member 13 is made of wire or any other suitable material; and it includes the leg portions 26 and 27 and a coil-like mid portion 29. This mid portion winds around the pin 28 and includes a finger 29*a* which serves as a stop to engage the housing 14 and prevent rotation beyond the position shown in FIG. 2. In this position, the support member co-operates with the base member 11 to form a stable base for the light emitting member or flashlight 12.

The flashlight 12 includes a round housing 30 pivotally connected to the base member 11 with a linkage 31, including a U-shaped portion 32, a pin 33, arm segments 34 and 35 and the pin 28. The housing 30 is a barrel-like structure made out of aluminum or any other suitable material; and it contains power generating means (e.g., single or multiple power sources, including regular and rechargeable batteries, an AA battery B, or one or more replacement batteries), a light emitting device such as a bulb E (or multiple lighting sources including incandescent, LED or high intensity bulbs such as Xenon bulbs), a reflector R, and a Lens L. (With some light emitting alternatives, one does not need a reflector or a lens.)

Figure 3:
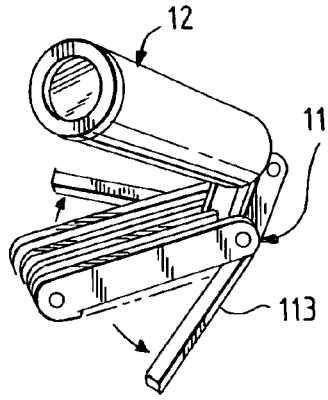
FIG. 3 is a perspective view of the flashlight apparatus of the present invention, showing a modified base member.
Figure 4:
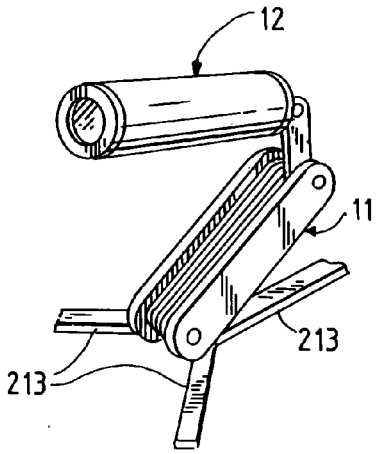
FIG. 4 is a perspective view of the flashlight apparatus of the present invention, showing a second modified base member.
Figure 5:
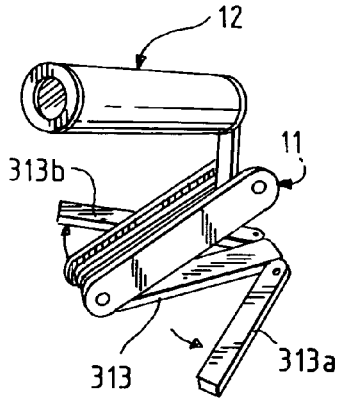
FIG. 5 is a perspective view of the flashlight apparatus of the present invention, showing a third modified base member.
Figure 6:
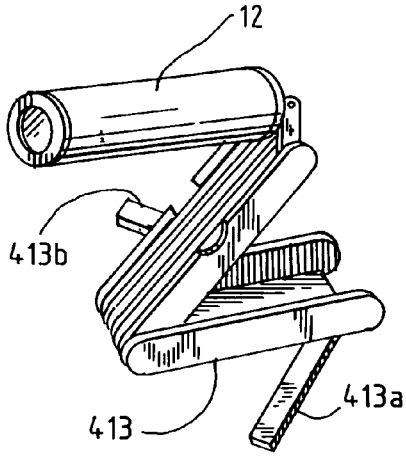
FIG. 6 is a perspective view of the flashlight apparatus of the present invention, showing a fourth modified base member in an open configuration.
Figure 7:
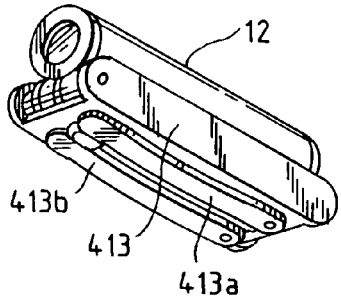
FIG. 7 is a perspective view of the flashlight apparatus of FIG. 6, showing the apparatus in a closed configuration.

FIGS. 3 to 7 show a number of modifications of the base member 11 and the support member 13. FIG. 3 shows a pair of support member 113 pivotally connected to the housing 14 at the pin 28 location. FIG. 4 shows three support member 213 pivotally connected to the housing 14 at the pin 23 location, while FIG. 5 shows a similar arrangement but with one support member 313 lying pivotally connected to the housing 14 at the pin 23 location and the other two support members 313*a* and 313*b* being pivotally connected to the distal end of the member 313. Finally, FIGS. 6 and 7 show an arrangement similar to that of FIG. 5 but with a support member 413 that has a channel-like configuration and support members 413*a* and 413*b* having a somewhat curved configuration and providing a spring function.

While the above description and the drawings disclose and illustrate one embodiment and a number of modifications of that embodiment, one should understand, of course, that the invention is not limited to this embodiment. Those skilled in the art to which the invention pertains may make other modifications and other embodiments employing the principles of this invention, particularly upon considering the foregoing teachings. Therefore, by the appended claims, the applicant intends to cover any modifications and other embodiments that incorporate those features which constitute the essential features of this invention.

What is claimed is:

1. A flashlight comprising:

a light emitting member pivotally attached to a first end of a generally rectangular channel base member, said channel base member containing a plurality of functional tools each pivotally attached to a second end of said channel base member, each of said tools pivoting outward for use;

a pair of support wires attached to said first end of said channel base member, said support wires having a projected position and a folded position, the support wires in said projected position projecting laterally from the channel base member forming a first acute angle with the base member and projecting upward from the channel base member forming a second acute angle with the base member, the support wires in said folded position running approximately parallel to the channel base member.

2. The flashlight of claim 1 wherein said support wires in the folded position are tucked into the base member.

3. The flashlight of claim 2 wherein at least one of said functional tools is chosen from the group consisting of: screwdriver, bottle-opener, knife, philip's screwdriver, file, and scissors.

4. The flashlight of claim 2 further comprising a linkage pivotally attached at a first end to said first end of said channel base member and pivotally attached at a second end to said light emitting member.

5. The flashlight of claim 2 wherein said light emitting member is tubular and contains a battery.

6. The flashlight of claim 2 wherein said light emitting member contains a bulb.

7. The flashlight of claim 2 wherein said light emitting member contains a means for turning said light emitting member on and off.

8. A flashlight comprising:

a light emitting member pivotally attached to a first end of a generally rectangular support member, said support member containing a plurality of functional tools each pivotally attached to a second end of said support member, each of said tools pivoting outward for use, said second end of said support member being pivotally attached to a first end of a generally rectangular channel base member, said channel base member having a substantially flat bottom surface;

a pair of support feet pivotally attached on said bottom surface of said channel base member at a second end of said channel base member, said feet pivoting laterally to provide lateral support for said flashlight.

9. The flashlight of claim 8 wherein said feet are elongate thin clips.

10. The flashlight of claim 9 wherein said elongate thin clips form a pocket attach when pivoted parallel to said channel base member.

11. The flashlight of claim 9 wherein said elongate thin clips are slightly arched such that when the clips are pivoted parallel to the channel base member, the clips contact the bottom flat surface of base member at their ends.

12. The flashlight of claim 8 wherein at least one of said functional tools is chosen from the group consisting of: screwdriver, bottle-opener, knife, philip's screwdriver, file, and scissors.

13. The flashlight of claim 8 further comprising a linkage pivotally attached at a first end to said first end of said support member and pivotally attached at a second end to said light emitting member.

14. The flashlight of claim 8 wherein said light emitting member is tubular and contains a battery.

15. The flashlight of claim 8 wherein said light emitting member contains a bulb.

16. The flashlight of claim 8 wherein said light emitting member contains a means for turning said light emitting member on and off.

* * * * *